US012275563B2

(12) United States Patent
Ham

(10) Patent No.: US 12,275,563 B2
(45) Date of Patent: Apr. 15, 2025

(54) STACKABLE CONTAINER

(71) Applicant: Lancayle Heath Ham, Plant City, FL (US)

(72) Inventor: Lancayle Heath Ham, Plant City, FL (US)

( * ) Notice: Subject to any disclaimer, the term of this patent is extended or adjusted under 35 U.S.C. 154(b) by 27 days.

(21) Appl. No.: 18/351,660

(22) Filed: Jul. 13, 2023

(65) Prior Publication Data

US 2024/0336392 A1 Oct. 10, 2024

Related U.S. Application Data

(60) Provisional application No. 63/494,559, filed on Apr. 6, 2023.

(51) Int. Cl.
*B65D 5/00* (2006.01)

(52) U.S. Cl.
CPC ..... *B65D 5/0015* (2013.01)

(58) Field of Classification Search
CPC ..... B65D 5/0015
See application file for complete search history.

(56) References Cited

U.S. PATENT DOCUMENTS 2,316,261 A * 4/1943 Levkoff ..... B65D 5/3642 229/160
2,439,959 A * 4/1948 Anderson, Jr. ..... B65D 5/22 229/165
3,887,126 A * 6/1975 Wilson ..... B65D 5/22 229/176
3,899,121 A 8/1975 Herbetko
3,940,053 A 2/1976 Putman et al.
3,973,723 A * 8/1976 Owens ..... B65D 5/6632 229/176
4,151,948 A 5/1979 de la Fuente, Jr.
(Continued)

FOREIGN PATENT DOCUMENTS

CA 2876185 C * 6/2017 ..... B31B 50/00
DE 102017004556 A1 * 11/2017 ..... B65D 5/003
(Continued)

OTHER PUBLICATIONS (FR2837465A1) English Translation (Year: 2024).*
International Search Report and Written Opinion; PCT/US2024/017448; Mailed May 17, 2024.

*Primary Examiner* — Don M Anderson
*Assistant Examiner* — Justin Caudill
(74) *Attorney, Agent, or Firm* — Dunlap Bennett & Ludwig, PLLC

(57) ABSTRACT

A stackable container foldable from a unitary blank providing a tongue-and-groove configuration of interlocking panels and tabs. The tongue-and-groove configuration is in part defined by four tabs that are folded and fixed along an interior of the stackable container, wherein the tab provides a tongue element and wherein a bottom panel of the stackable container provides a groove element for receiving a tongue element of a subjacent container, thereby enabling stacking of two or more stackable containers, one on top of another. In the stacked arrangement, the tongue-and-groove configuration embodied in the present invention prevents, in conjunction with the orientation of corrugated flutes, swaying and shifting of a stacked arrangement of two or more stackable containers.

9 Claims, 4 Drawing Sheets

(56) References Cited

U.S. PATENT DOCUMENTS 4,164,315 A 8/1979 Pennanen
4,537,344 A * 8/1985 Thomas ..... B65D 5/003 229/905
4,957,409 A 9/1990 Fukao et al.
5,429,296 A * 7/1995 Southwell ..... B65D 5/2009 229/168
5,535,941 A * 7/1996 Garza ..... B65D 5/002 229/918
5,593,087 A 1/1997 Ross et al.
5,913,474 A 6/1999 Chu
6,158,652 A * 12/2000 Ruiz ..... B65D 5/26 229/177
6,302,323 B1 10/2001 Southwell
6,481,619 B1 11/2002 Jackson
6,581,772 B2 6/2003 Noland
6,719,191 B1 4/2004 Christensen et al.
6,899,266 B2 5/2005 Conway
6,938,820 B2 9/2005 Noone et al.
7,124,890 B2 10/2006 McLeod et al.
7,140,493 B2 11/2006 Fry
7,225,970 B2 * 6/2007 Philips ..... B65D 5/4608 229/179
8,640,871 B2 2/2014 Moss
9,156,578 B2 10/2015 Smith
9,463,895 B2 10/2016 Moreau et al.
11,161,643 B2 11/2021 Aziz
2005/0145687 A1 * 7/2005 Conway ..... B65D 21/0212 229/174
2007/0000984 A1 * 1/2007 McClure ..... B65D 5/443 229/190
2007/0017839 A1 * 1/2007 Sutherland ..... B65D 71/36 206/139
2009/0272789 A1 11/2009 Fry
2009/0314827 A1 * 12/2009 Grigor ..... B65D 5/0015 229/190
2013/0200137 A1 * 8/2013 Smith ..... B65D 1/225 493/454
2014/0326631 A1 * 11/2014 Cotie ..... B31B 50/262 229/187
2015/0251797 A1 * 9/2015 Carman ..... B65D 5/4295 229/148
2016/0122073 A1 * 5/2016 Aguirre ..... B65D 5/443 206/509
2019/0351636 A1 11/2019 Akita et al.
2021/0284377 A1 * 9/2021 Couture ..... B65D 5/4608
2022/0306334 A1 * 9/2022 Smith ..... B65D 5/0025
2022/0363421 A1 11/2022 Horii et al.
2023/0075729 A1 3/2023 Nadachi et al.

FOREIGN PATENT DOCUMENTS

FR 2837465 A1 9/2003
GB 2255076 A * 10/1992 ..... B65D 5/0035
GB 2276612 A 10/1994

* cited by examiner

STACKABLE CONTAINER

CROSS-REFERENCE TO RELATED APPLICATION

This application claims the benefit of priority of U.S. provisional application No. 61/939,769, filed 6 Apr. 2023, the contents of which are herein incorporated by reference.

BACKGROUND OF THE INVENTION

The present invention relates to stackable containers and, more particularly, a container foldable from a unitary flat blank to form a stackable container having a tongue-and-groove configuration.

Boxes holding various items are hard to stack on other boxes because each box tends to shift relative to each other in the stack when there is no stabilizing mechanism. Current stackable trays can be challenging to manually form from a flat blank to a folded, operative box because of their complexity. This complexity and resulting time to form the stackable trays is a burden for smaller businesses that need hundreds of such containers and do not have the workforce to spend time folding complex boxes. Moreover, many foldable boxes require expensive folding machines to facilitate an effective operative stackable box, thereby adding an additional cost to the users of such stackable containers, prohibitively so for smaller businesses. Current blanks for foldable containers are also expensive just to manufacture as blanks because of the above-mentioned complexity.

As can be seen, there is a need for a stackable container providing a tongue-and-groove configuration so that a minimal of fold lines, panels and blank material is needed for a sturdy stacked arrangement of a plurality of stacked containers, thereby keeping the price lower than prior art stackable containers.

SUMMARY OF THE INVENTION

The tongue-and-groove configuration is in part defined by two components: (a) at each corner of the flat blank an isolated tab, that when the stackable container is being formed, is folded and then adhesively fixed along an interior surface of the stackable container so as to provide an upward projecting tongue element; and (b) a bottom panel of the stackable container that provides a groove element for receiving the tongue element of a subjacent stackable container. Thereby, the tongue-and-groove configuration enables stacking of two or more stackable containers, one on top of another in a stacked arrangement, that form a locked engagement by way of the operatively association of the tongue and groove elements. In the stacked arrangement, the tongue-and-groove configuration embodied in the present invention supports, in conjunction with the orientation of corrugated flutes, the weight of the container and its contents and provides stability that prevents swaying and shifting of the stacked arrangement.

In one aspect of the present invention, a stackable container formed from a unitary blank of corrugated material includes the following: a bottom panel along a perimeter of the bottom panel, two side panels and two end panels foldably joined to the perimeter; an isolated corner tab foldably joined to each end of each side panel; a tongue element provided along an upper edge of each isolated corner tab; and for each tongue element, a groove element disposed in the bottom panel so that the tongue element is substantially within a profile of the groove element, wherein an orientation of flutes of the corrugated material is orthogonal relative to a longitudinal axis of the two side panels.

In another aspect of the present invention, the stackable container further includes wherein an exterior surface of each isolated corner tab is fixed to an interior surface of one of the two end panels, wherein each isolated corner tab has a bottom edge at an elevation that is spaced apart from an elevation of an upper surface of the bottom panel, thereby defining a vertical offset therebetween, and wherein each tongue element is spaced apart from the end of the side panel.

In yet aspect of the present invention, a stackable container system of a plurality of the above-disclosed stackable containers includes wherein the plurality of stackable containers forming a stackable condition, wherein the tongue elements of a subjacent stackable container are slidably received into the groove elements of an adjacent stackable container, wherein each tongue element is downward of the isolated corner tabs of the adjacent stackable container, forming a locked engagement.

These and other features, aspects and advantages of the present invention will become better understood with reference to the following drawings, description, and claims.

DETAILED DESCRIPTION OF THE INVENTION

Figure 1:
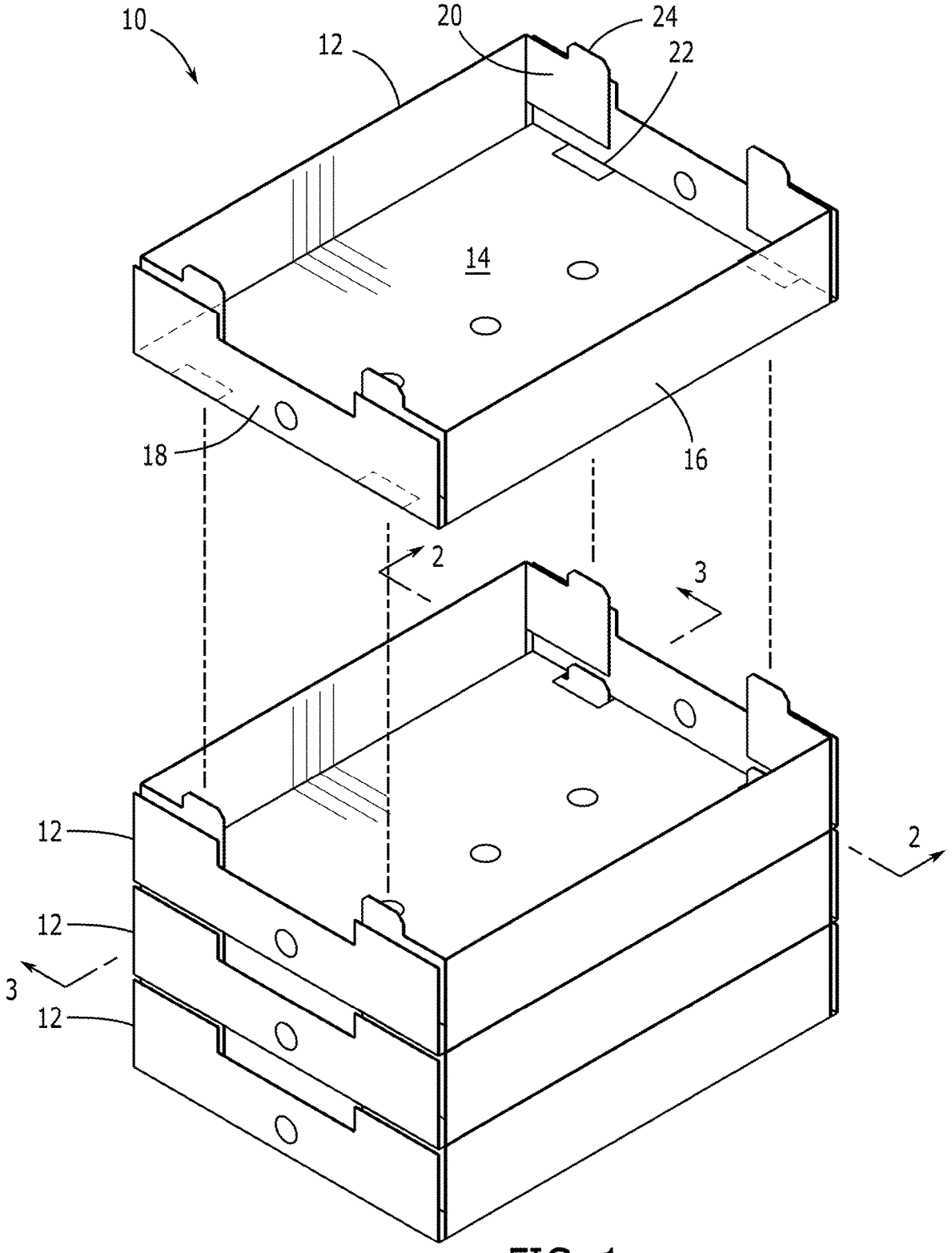
FIG. 1 is an exploded top view of an exemplary embodiment of the present invention.
Figure 2:
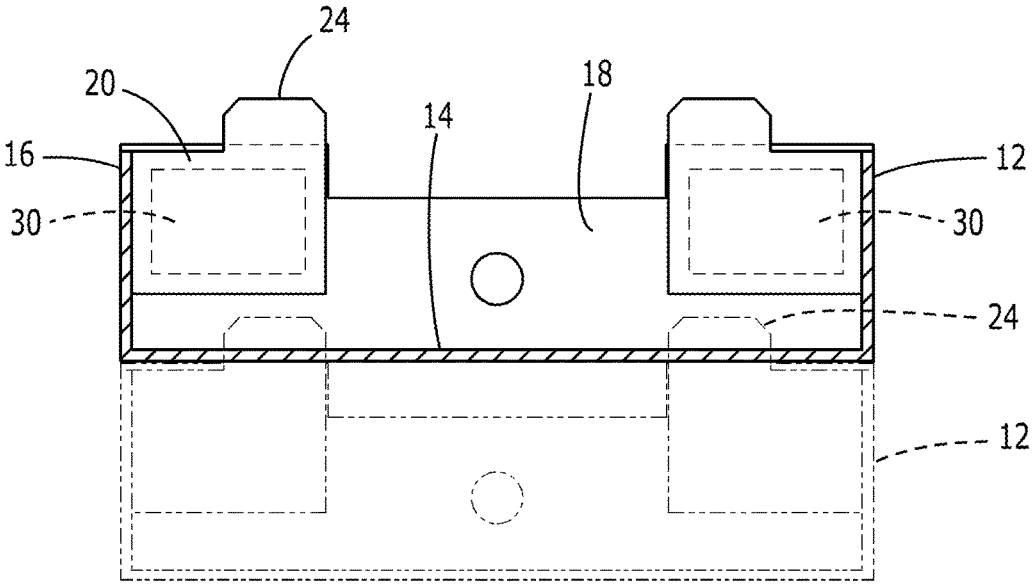
FIG. 2 is a cross-section view of an exemplary embodiment of the present invention, taken along line 2-2 in FIG. 1.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Referring to FIGS. 1 through 5C, the present invention may include a stackable container 12 with a tongue-and-groove configuration that is foldable from a unitary flat blank 50 of material to an operative stackable container 12 for holding contents. In the operative container 12, an isolated corner tab 20 of the flat blank 50 provides a tongue element 24 of the folded container 12, while and bottom panel 14 of the container 12 provides a slot or groove element 22 for receiving a tongue element 24 of a subjacent container 12, thereby enabling a stacked condition 10 of two or more containers 12 in a locked engagement.

The stackable container 12 contemplates manual folding as well as use of a push machine to fold the present invention from a flat condition, embodied in a unitary blank of material 50, to a folded condition defining the stackable container 12 in an operative condition, wherein the dimensions can change if the present invention is shaped and adaptable as disclosed herein.

Figure 4:
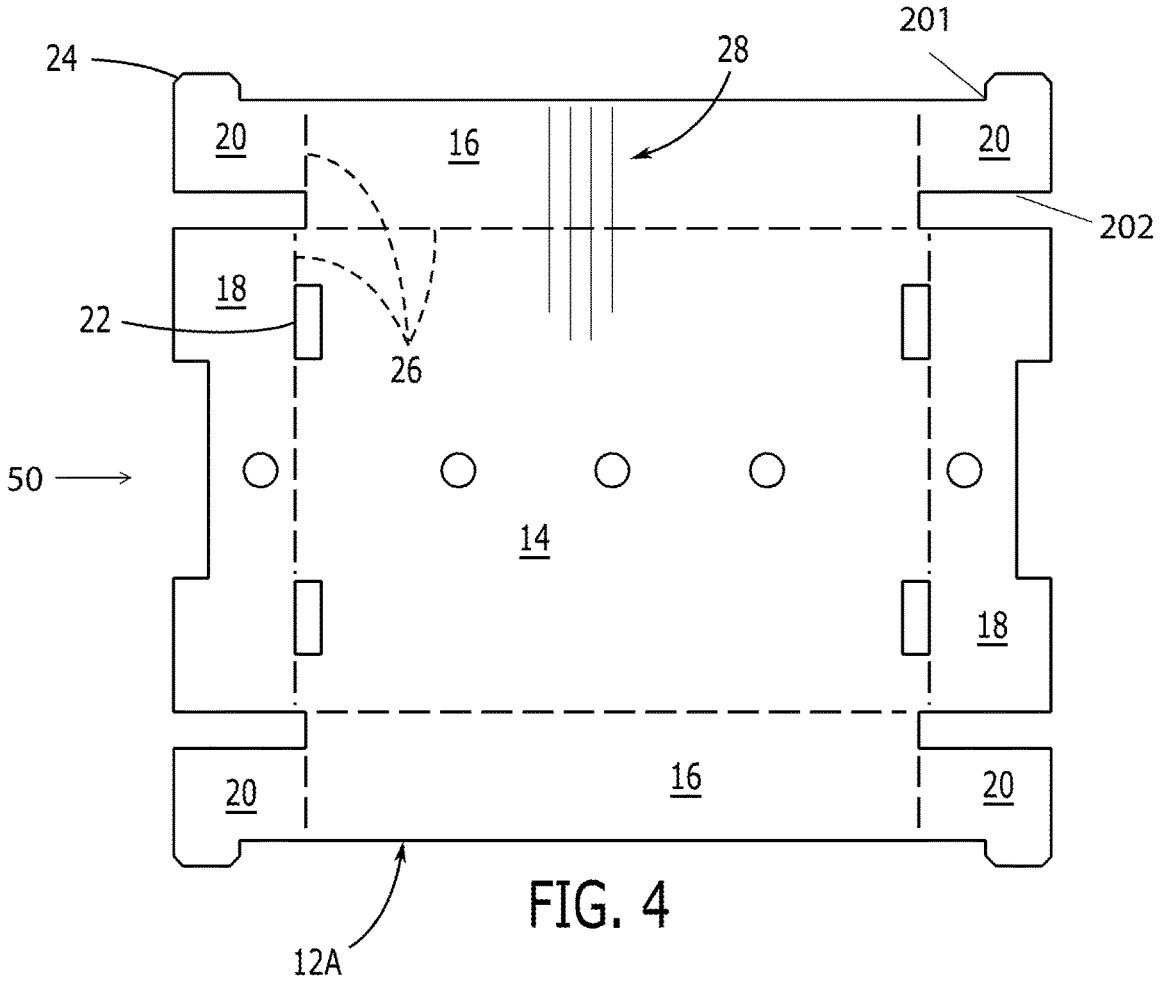
FIG. 4 is a top plan view of an exemplary embodiment of the present invention.

Referring to FIG. 4, the flat condition/unitary blank 50 has a bottom panel 14 attached to a first side panel 16, a second side panel 16, a first end panel 18, and a second end panel 18 along fold lines 26. The first and second side panels 16 each have a first isolated corner tab 20 and a second isolated corner tab 20, respectively, connected along fold lines 26 to each of their opposing longitudinal ends. In the depicted embodiment, the first and second isolated corner tabs 20 are substantially similar in shape, size, and dimensions. In other embodiments, the first isolated corner 20 and second isolated corner 20 may vary relative to each other.

Each isolated corner tab 20 has a bottom edge 202 that is spaced apart from other panels 14, 18 of the blank 50, thereby "isolating" the corner tab 20 by way of a gap. Each isolated corner tab 20 also has a top edge 201 that provides a tongue element 24 projecting therefrom. The stack tongue 24 may be generally rectangular with one or more rounded corners along the top edge 201. The tongue element 24 is at a distal edge of the isolated corner tab 20 and so ends prior to its respective fold line 26. Each tongue element 24 is substantially the same length and preferably a shape substantially mirroring each other respective to the blank 50.

The blank 50 may be corrugated material, paper-based or other substantially durable and formable material. The corrugated material provides flutes 28, wherein the flutes 28 have a flute direction orthogonal relative to the longitudinal axis of the side panels 16 and the bottom panel 14 of the blank 50. The orthogonal orientation of the corrugated flutes 28 relative to the length of the container 12 (as defined by the bottom panel 14) provides greater bending strength to the container 12 along its longitudinal edges, critically providing side-to-side stability of one container 12 relative to another container 12 in a stacked condition 10.

The bottom panel 14 provides stack slots or groove elements 22 adjacent or contiguous relative to the fold lines 26 that connect the first and second end panels 18. Each tongue element 24 is shaped and positioned to substantially align with a respective groove element 22 when the blank 50 is moved from its flat condition to the folded, operative condition of the stackable container 12. Similarly, the perimeter of each groove element 22 is dimensioned and shaped to receive the thickness of the corrugated material of the tongue element 24 of a subjacent container 12 of the stacked condition 10.

Figure 3:
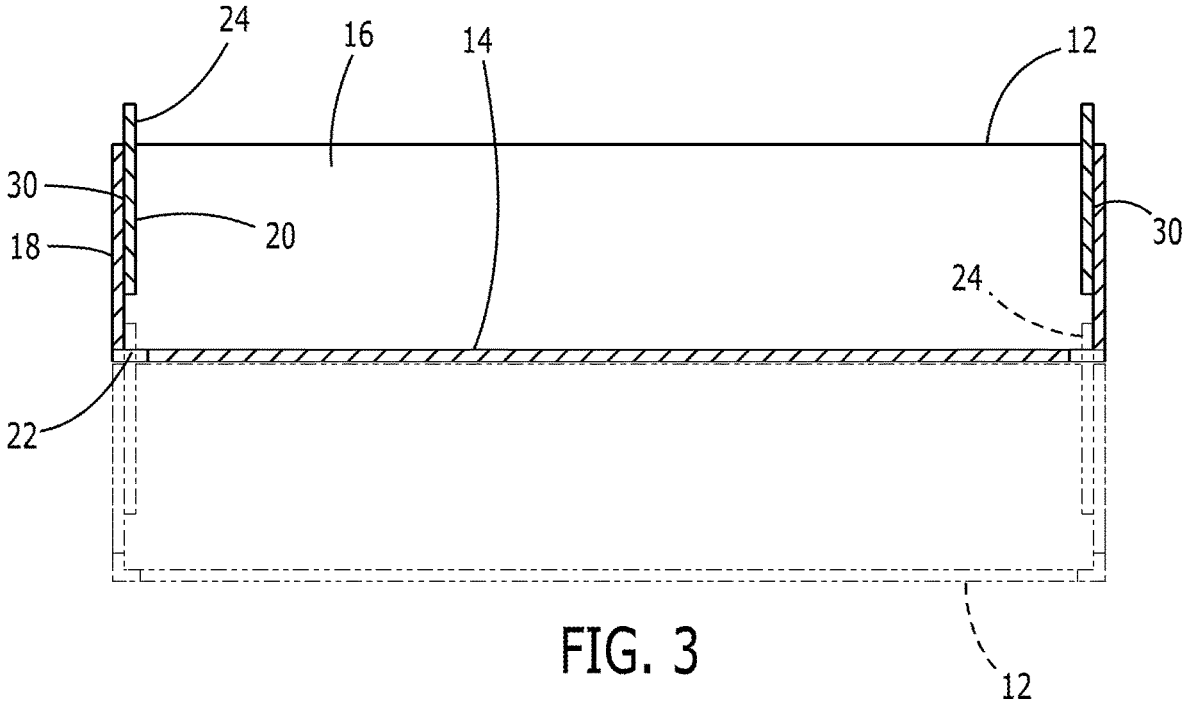
FIG. 3 is a cross-section view of an exemplary embodiment of the present invention, taken along line 3-3 in FIG. 1.
Figure 5A:
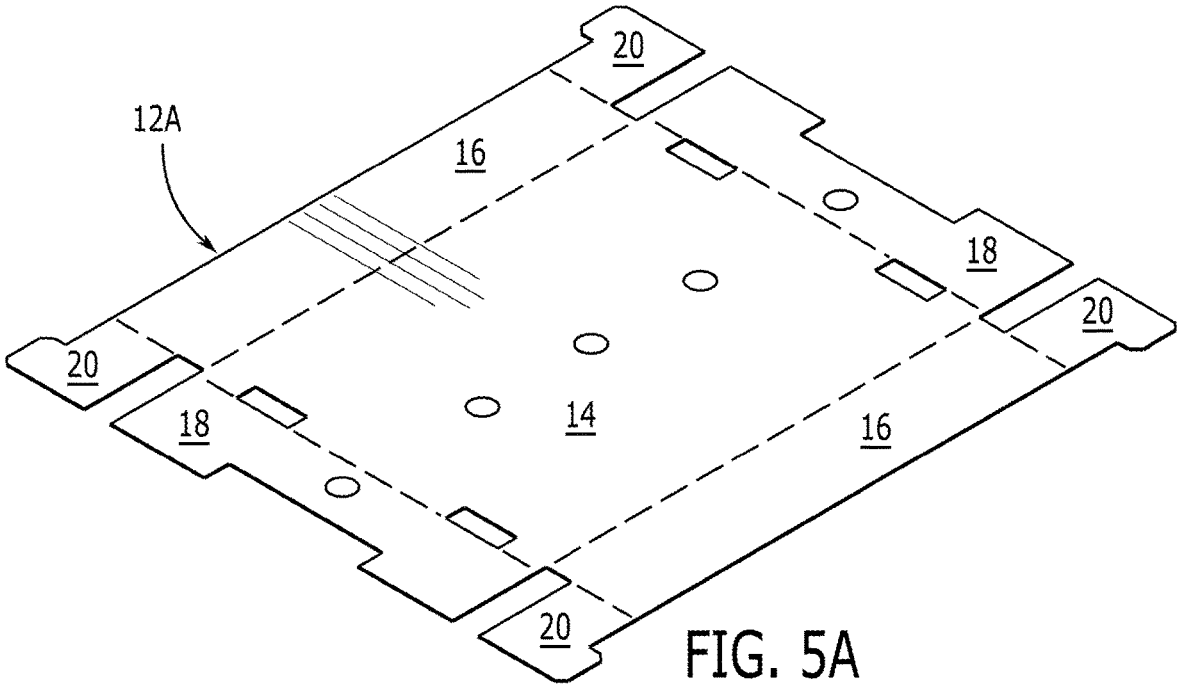
FIG. 5A is a perspective view of an exemplary embodiment of the present invention, illustrating a unitary blank prior to a folding process.
Figure 5B:
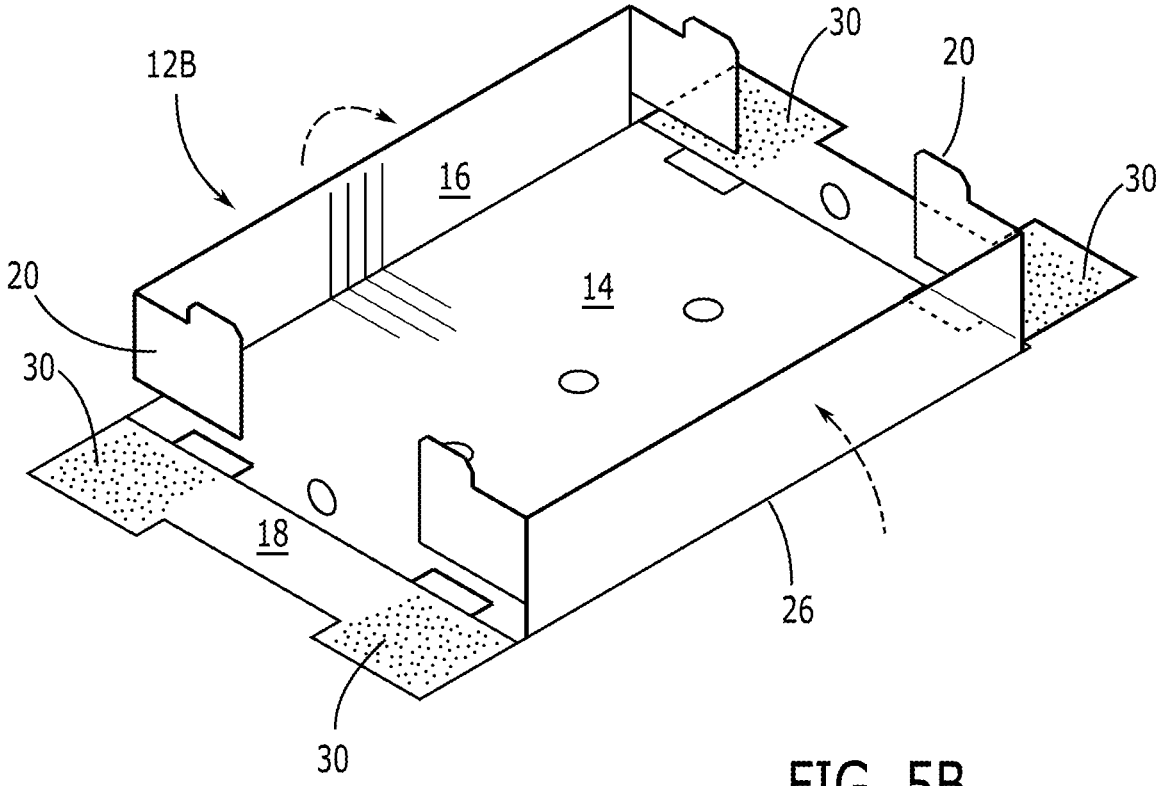
FIG. 5B is a perspective view of an exemplary embodiment of the present invention, illustrating the first step of the folding process.
Figure 5C:
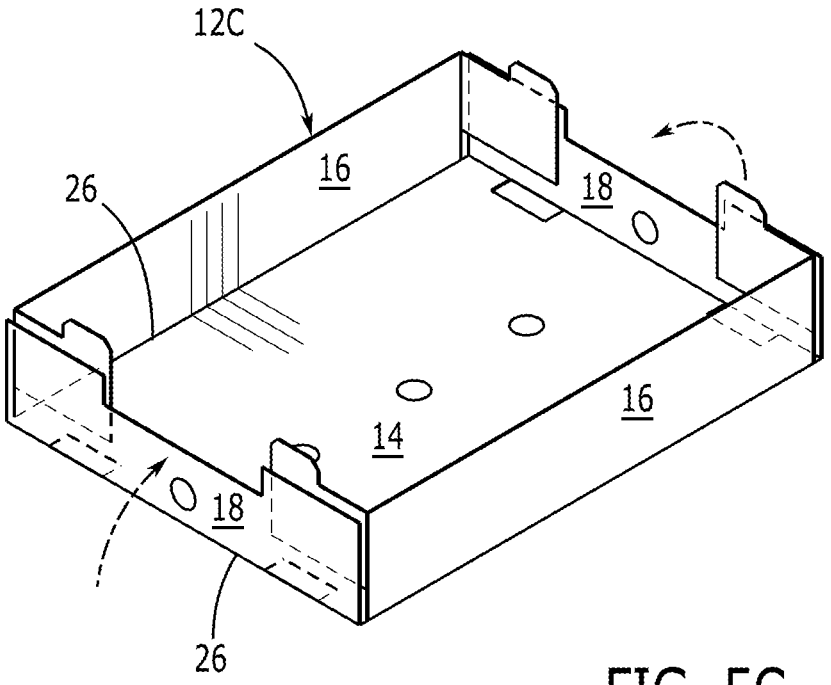
FIG. 5C is a perspective view of an exemplary embodiment of the present invention, illustrating a second step of the folding process.

FIGS. 5A through 5C illustrate the fabrication of the stackable container 12 from the flat blank 50. The panels 14, 16 and 18 are folded along the respective fold lines 26. When forming the stackable condition 12, the exterior surface of each isolated corner tab 20 interfaces an interior surface of an adjacent portion of the end panel 18. An adhesive 30, bonding agent (e.g., glue) along the interfacing surface or connectors (e.g., staples) fix the connection between the isolated corner tab 20 and the interior surface of the adjacent portion of the end panel 18. When a stacked container 12, the tongue elements 24 align with a portion of their respective groove elements 22. In other words, each tongue element occupies a portion of the profile of the groove element 22. By profile, it understood to be the (vertical) projection of a perimeter of, here, the groove element 22, as can be seen in FIG. 3.

Because of the gap between the bottom edge 202 of the isolated corner tab 20 and the bottom panel 14, the tongue element 24 from the subjacent container 12 (in the stacked condition 10) can slide through the groove element 22 yet not contact the isolated corner tab 20 of the above container 12. The offset or gap of the isolated corner tab 20 from the body panel 14 enables the tongue element 24 of a subjacent stacked container 12 to slide into the groove element 22 in the above stacked container 12—forming a locked engagement therebetween—which stops shifting. The walls and double thickness of isolated corner tab 20/end panel 18 holds the weight in combination with the orientation of the corrugated flutes 28 of the material of the stacked container 12.

A method of making the present invention may include the following. A manufacturer may design a layout of box of any box size using the layout shown and disclosed herein, and then cut blanks 50, accordingly, if there is the tongue-and-groove configuration disclosed herein.

A method of using the present invention saves cost of production, uses less material with same weight rating, and facilitates stability from shifting in a stack of containers, enabling an easy way of folding and gluing the container together, while saving space of expense on the blank material when not folded and glued.

Additionally, the box layout and be used in field just by changing box size as long as a tongue on the inside flap location and hole on box would have the same configuration as disclosed herein.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. A stackable container formed from folding a unitary blank of corrugated material from a flat condition to a folded condition of the stackable container, the stackable container comprising:

a bottom panel;

along a perimeter of the bottom panel, two side panels and two end panels directly and foldably joined to the perimeter by way of two side fold lines and two end fold lines, respectively;

an isolated corner tab foldably joined to each end of each side panel, wherein each isolated corner tab has a bottom edge that defines an offset relative to (a) an adjacent end panel of the two end panels in the flat condition and to (b) the bottom panel in the folded condition;

a tongue element provided along a top edge of each isolated corner tab; and for each tongue element, a groove element disposed in the bottom panel so that, in the folded condition, the tongue element is substantially within a profile of the groove element, whereby the offset facilitates folding of the unitary blank and stacking of the stackable container with another stackable container.

2. The stackable container of claim 1, wherein, in the folded condition, an exterior surface of each isolated corner tab is fixed directly to an interior surface of one of the two end panels.

3. The stackable container of claim 1, wherein each tongue element is spaced apart from the end of the side panel.

4. A stackable container system of a plurality of stackable containers of claim 1, the stackable container system comprising:

the plurality of stackable containers forming a stackable condition, wherein the tongue elements of a subjacent stackable container are slidably received into the groove elements of an adjacent stackable container, wherein each tongue element is downward of the isolated corner tabs of the adjacent stackable container, forming a locked engagement.

5. The stackable container of claim 1, wherein an orientation of flutes of the corrugated material is orthogonal relative to a longitudinal axis of the two side panels.

6. The stackable container of claim 5, wherein each tongue element latitudinally, orthogonal to said longitudinal axis, projects from the respective top edge of the side panels so that top edges the tongue elements both (a) latitudinally project beyond all longitudinal edges of the remaining elements of the unitary blank in the flat condition and (b) are uppermost elements of the stackable container in the folded condition.

7. The stackable container of claim 1, wherein an offset distance of said offset is at least one-half of an inch.

8. The stackable container of claim 7, wherein each tongue element projects a predetermined distance from a respective top edge in a direction orthogonal to said longitudinal axis, and wherein the predetermined distance is less than said offset distance.

9. The stackable container of claim 7, wherein each tongue element is fixedly attached to directly the respective top edge.

* * * * *